US006422801B1

(12) United States Patent
Solomon

(10) Patent No.: US 6,422,801 B1
(45) Date of Patent: Jul. 23, 2002

(54) AUTOMATIC PLATE FEEDING SYSTEM

(75) Inventor: Yehuda Barnes Solomon, Rishon Lezion (IL)

(73) Assignee: Creo Scitex Corporation Ltd., Herzlia (IL)

( * ) Notice: Subject to any disclaimer, the term of this patent is extended or adjusted under 35 U.S.C. 154(b) by 0 days.

(21) Appl. No.: 09/571,325

(22) Filed: May 15, 2000

(30) Foreign Application Priority Data

May 18, 1999 (IL) ..... 130018

(51) Int. Cl.[7] ..... B65H 3/44

(52) U.S. Cl. ..... 414/416.07; 414/752.1; 414/797; 271/9.07; 271/9.11

(58) Field of Search ..... 414/416.07, 752.1, 414/797; 271/9.07, 9.11

(56) References Cited

U.S. PATENT DOCUMENTS

| | | | | |
|---|---|---|---|---|
| 4,212,263 A | | 7/1980 | Hillhouse | |
| 4,483,527 A | | 11/1984 | Hashimoto et al. | |
| 4,667,948 A | | 5/1987 | Angelbeck et al. | |
| 4,878,799 A | | 11/1989 | Seto et al. | |
| 4,984,260 A | * | 1/1991 | Koyama | 271/9.07 X |
| 5,367,360 A | | 11/1994 | McIlwraith et al. | |
| 5,368,284 A | | 11/1994 | Renth | |
| 5,488,906 A | | 2/1996 | Iron et al. | |
| 5,655,452 A | | 8/1997 | Blake et al. | |
| 5,738,014 A | | 4/1998 | Rombult et al. | |
| 5,785,309 A | | 7/1998 | Halup et al. | |
| 5,788,455 A | | 8/1998 | Krupica et al. | |
| 5,791,250 A | | 8/1998 | Blake et al. | |
| 5,809,360 A | | 9/1998 | Blake et al. | |
| 5,992,324 A | | 11/1999 | Rombult et al. | |
| 6,000,337 A | | 12/1999 | Blake et al. | |
| 6,164,637 A | | 12/2000 | Harari | |

FOREIGN PATENT DOCUMENTS

| | | | | |
|---|---|---|---|---|
| DE | 3828439 | * | 3/1990 | 271/9.11 |
| DE | 41 05 269 C1 | | 9/1992 | |
| DE | 40 38 544 A1 | | 11/1992 | |
| EP | 0900752 A2 | | 3/1999 | |
| JP | 62215444 | * | 9/1987 | 414/797 |

OTHER PUBLICATIONS

Seybold Report on Publishing Systems, vol. 24, No. 20, ISSN: 0736–7260, Jun. 26, 1995.

Barco Graphics, Lithosetter, Product Literature, May 1995, 4 pages.

Richard M. Adams, II, and Romano, Frank, Computer–to–Plate: Automating the Printing Industry, pp. 135–142, 143–150, 159–170, 177–182, Graphic Arts Technical Foundation (1st Edition, 1996).

Michael Limburg, The Essentials of Computer–to–Plate Technology, pp. 48–49, Graphic Arts Technical Foundation, (1995).

ICG Titan 582, Product Literature, May 1995.

* cited by examiner

*Primary Examiner*—Steven A. Bratlie
(74) *Attorney, Agent, or Firm*—Eitan, Pearl, Latzer & Cohen-Zedek

(57) ABSTRACT

An automatic plate feeding system for loading plates of various sizes into a printing plate imaging device, which includes a plurality of trays staggered one on top of the other, and an arm mechanism for loading plates from the plurality of trays and feeding the loaded plates to the imaging device.

6 Claims, 7 Drawing Sheets

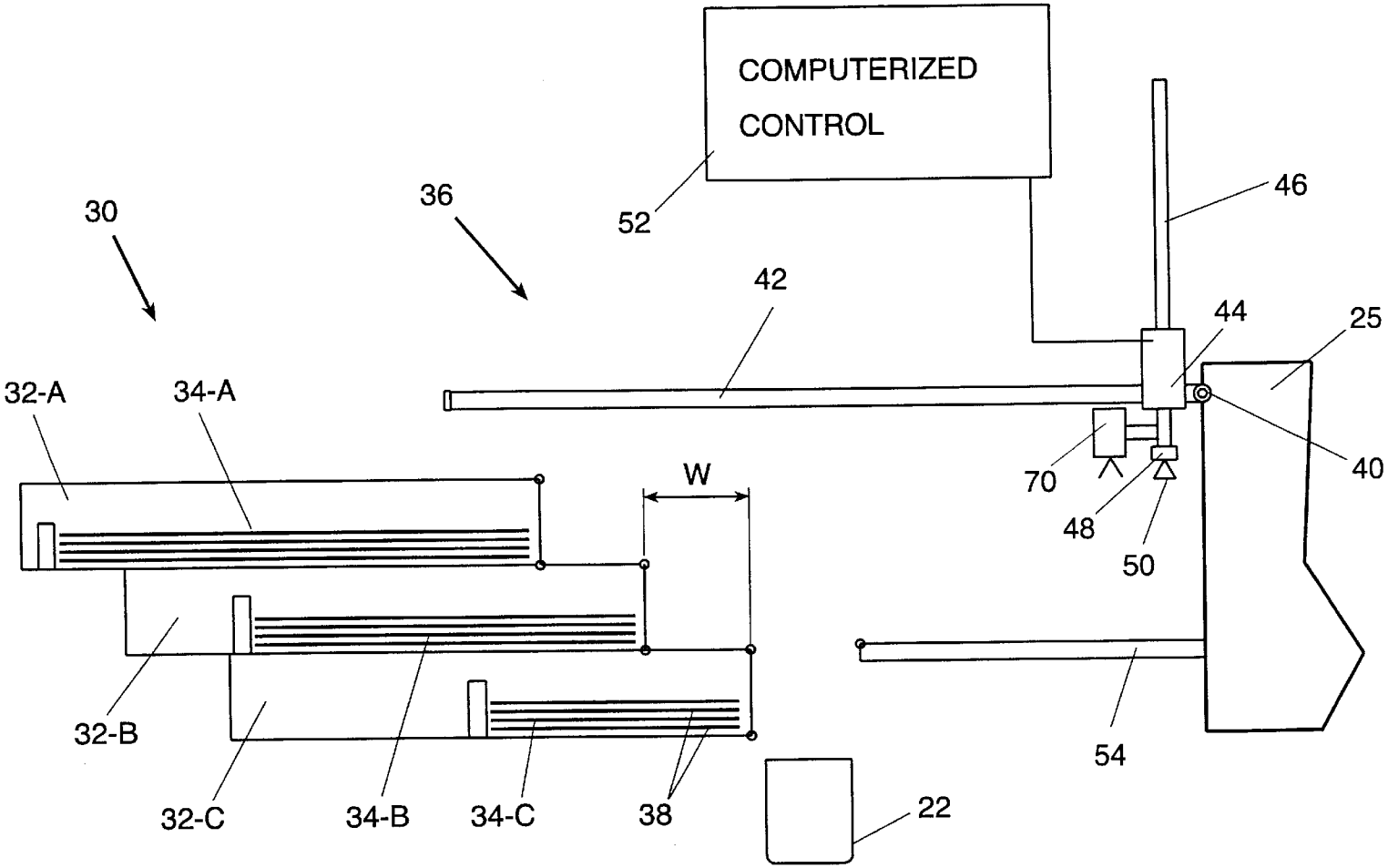
FIG.2-A

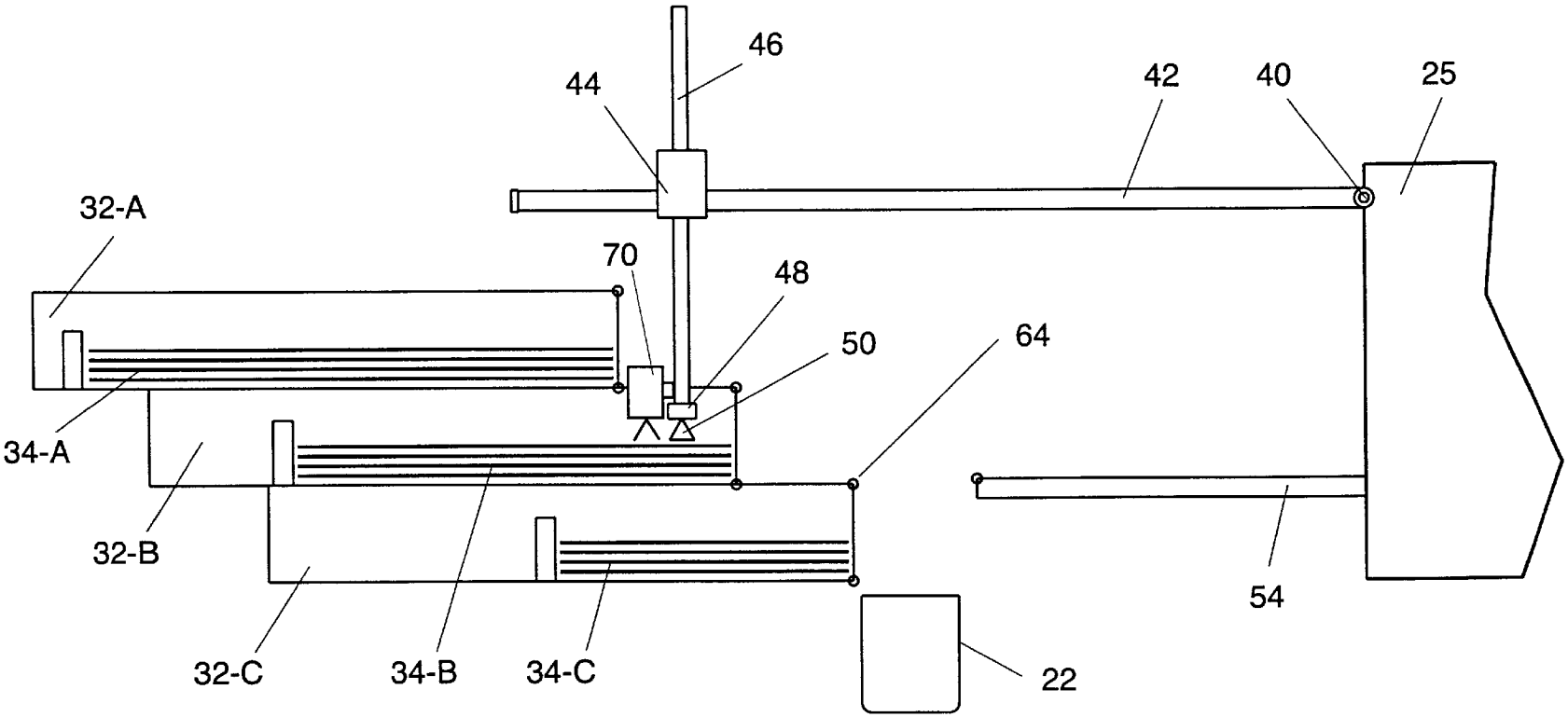
FIG.2-B

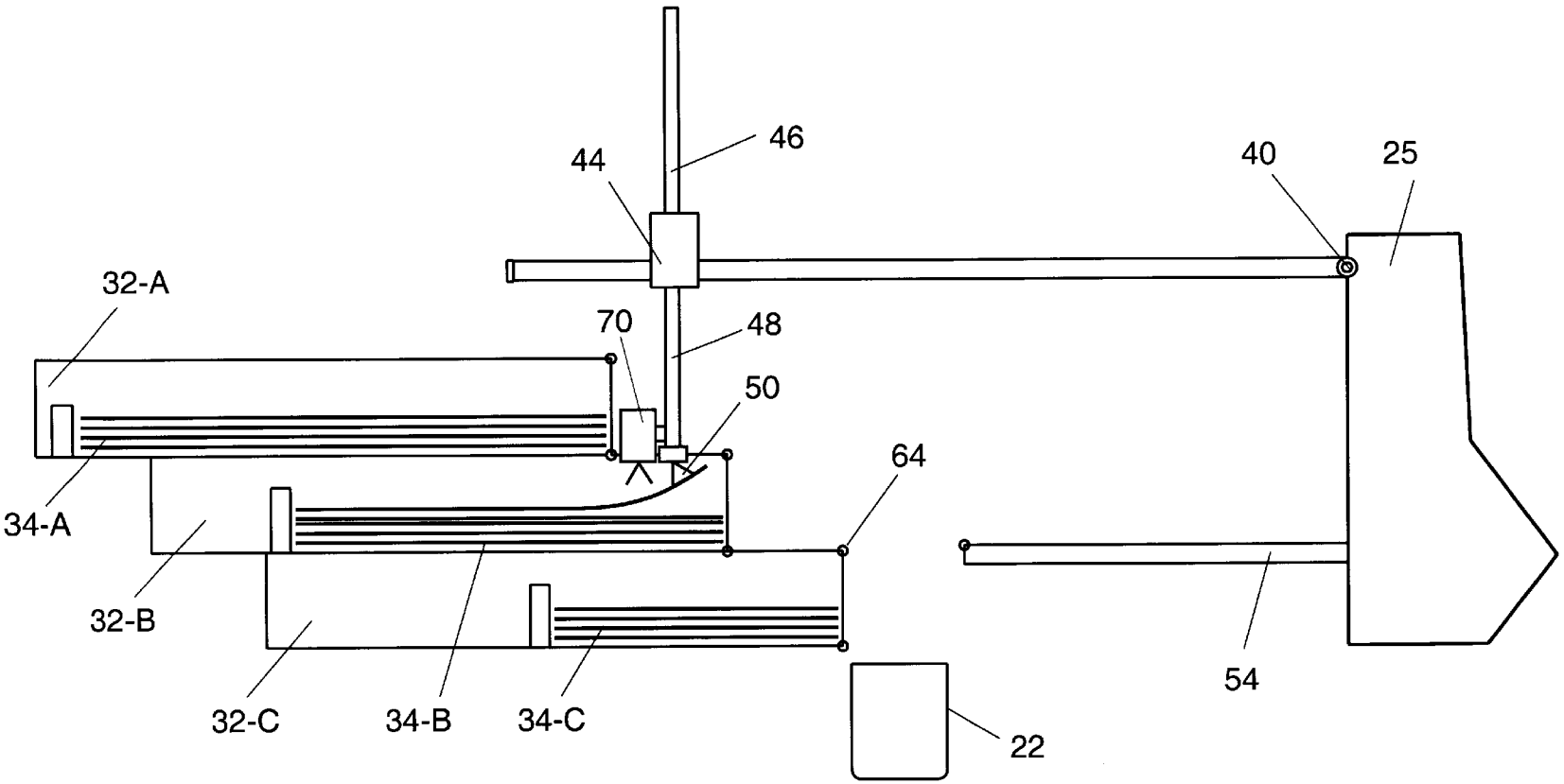
FIG.2-C

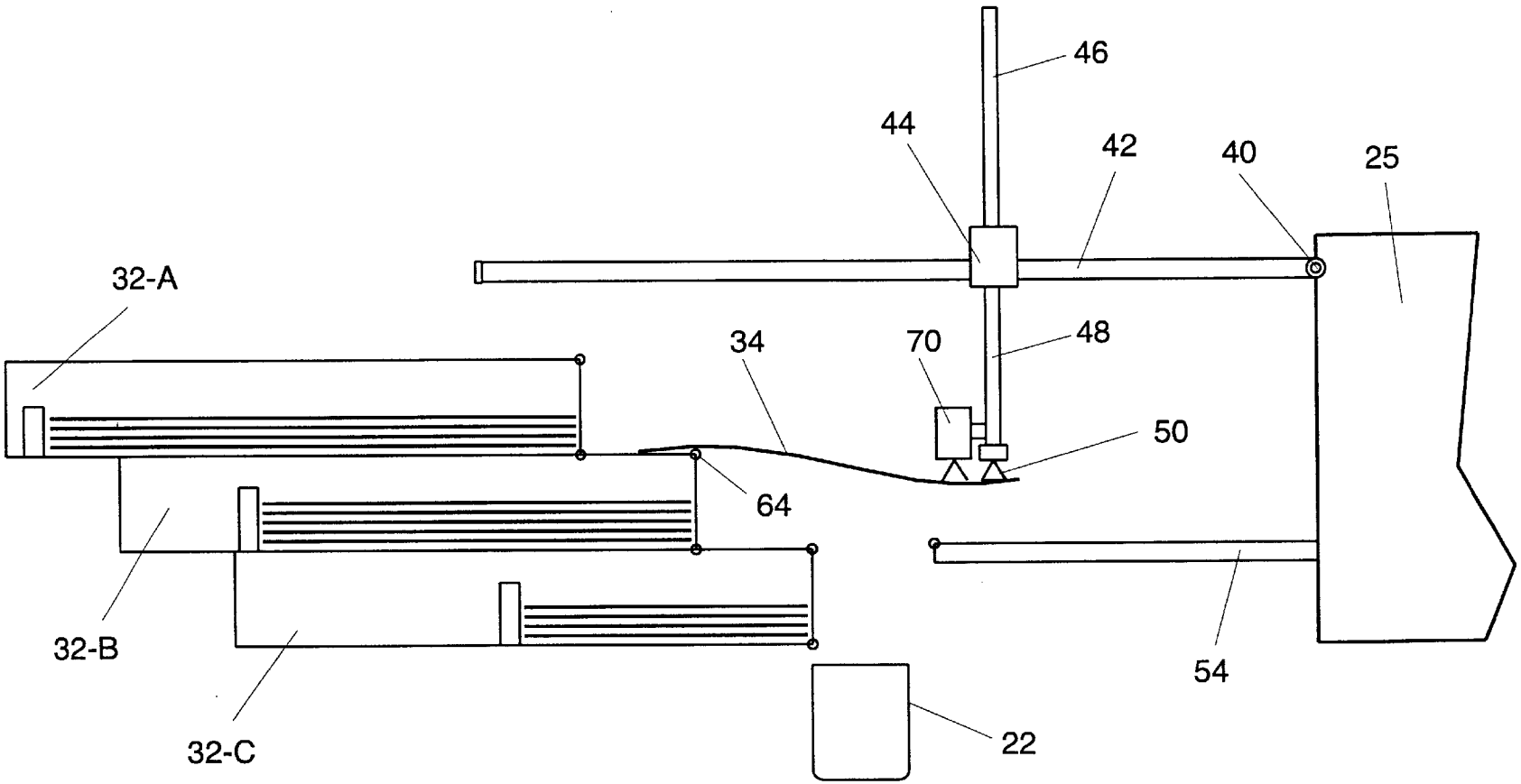
FIG.2-D

AUTOMATIC PLATE FEEDING SYSTEM

FIELD OF THE INVENTION

The present invention generally relates to a system for loading a printing plate into a plate imaging device and specifically to a system for automatic loading of plates of various sizes into a plate setter or a printing plate imaging device.

BACKGROUND OF THE INVENTION

A variety of systems and applications use stacks of sheets or plates, which may be made of metal, paper, plastic and the like. Printing plates (hereinafter singly or collectively referred to as "plates") are typically stacked in a cassette or similar container which houses the plates and facilitates their protection, transportation and handling.

A specific system using plates generally uses trays having specific dimensions. Trays can usually be set to contain plates of various sizes, but all plates in the same tray are of one size. Usually the plates are manually removed from the cassette or the shipping container and inserted into the trays for use by the system, for example, a plate image system.

Plates are usually packed in the cassette with intermediate paper sheets, hereinafter referred to as 'separation paper'. The separation papers are disposed during loading into the imaging device by a mechanism such as described in U.S Pat. No. 6,164,637, assigned to the common assignee of the present invention.

A typical conventional plate feeding system from a tray is shown schematically in FIG. 1. Plates 12 are supplied, within a tray 14, stacked one on top of the other with separation papers 16 between the plates.

Various mechanisms have been developed for removing a single plate 12 from the tray 14 and loading it using loading arm 18 to the loading plane 23 of the imaging system 20. Usually the feeding system includes a mechanism for disposing of the separation paper 16 into a paper bin 22 illustrated, for example.

One such system is described in U.S. Pat. No: 5,785,309 assigned to the common assignee of the present invention. The loading method described has the disadvantage in that, if a different plate size needs to be loaded for a subsequent operation, then the tray in use needs to be replaced by a tray containing the required plate size, or the tray itself needs to be replenished with plates of the required size. Replacing cassettes is a costly procedure and time consuming operation.

U.S. Pat. No. 5,367,360 to McIlwraith et al. describes a method for loading plates from a single tray. In this case, the cardboard shipping container is used as a tray and the plates are lifted and loaded vertically by a vacuum system.

The use of several trays with the same system is known in the art of copiers, for example, where paper is loaded selectively from different trays. The trays are stacked one on top of the other, each having a separate loading mechanism.

U.S. Pat. Nos. 5,655,452, 5,738,014 5,791,250, 5,788,455 describe an apparatus and method of loading plates from a plurality of trays into an imaging device. The trays are stacked one on top of the other and moved by an elevator mechanism to allow a loading arm to enter between the trays and pick-up a specific plate.

Trays containing printing plates are heavy and bulky, and moving such tray up and down requires complicated and expensive mechanism and is time consuming. There is, thus a widely recognized need for an automatic and efficient handling system of feeding plates of various sizes, without the need to move trays. consuming There is, thus a widely recognized need for an automatic and efficient handling system of feeling plates of various sizes, without the need to move trays.

SUMMARY OF THE INVENTION

The present invention discloses a relatively compact system for automatically feeding plates of various sizes from a group of staggered trays.

The present invention provides an automatic plate feeding system, which can be used to automatically feed plates of various sizes into a printing plate imaging device.

According to the present invention, there is provided a plate feeding system for grasping and moving a plate from a stack of plates housed in a plurality of trays. The stack of trays are static and staggered.

The system includes a plurality of trays staggered one on top of the other, wherein at least two of the plurality of trays contain plates of different sizes, the plates usually have separation papers interposed there between; and an arm mechanism for loading plates from the trays and feeding them to an imaging device.

The arm mechanism includes a plate grasping member for grasping the plate and a separation paper disposing system. The grasping mechanism is movable perpendicularly to the arm by a vertical rod which is movable by the carriage. The carriage is movable along the arm which is typically parallel to the plates.

The trays are staggered in a way that the grasping mechanism can be brought to each of the trays' openings, grasp a plate and feed it to the imagesetter, or grasp a separation sheet and dispose it into the paper bin.

According to further features in the preferred embodiment of the invention described below, the plate grasping member is an array of suction cups.

BRIEF DESCRIPTION OF THE DRAWINGS

The present invention will be understood and appreciated more fully from the following detailed description taken in conjunction with the drawings in which:

FIGS. 2A, 2B, 2C and 2D schematically illustrate the multi-tray plate feeding system, constructed and operative in accordance with an embodiment of the present invention;

DESCRIPTION OF THE PREFERRED EMBODIMENT

Figure 1:
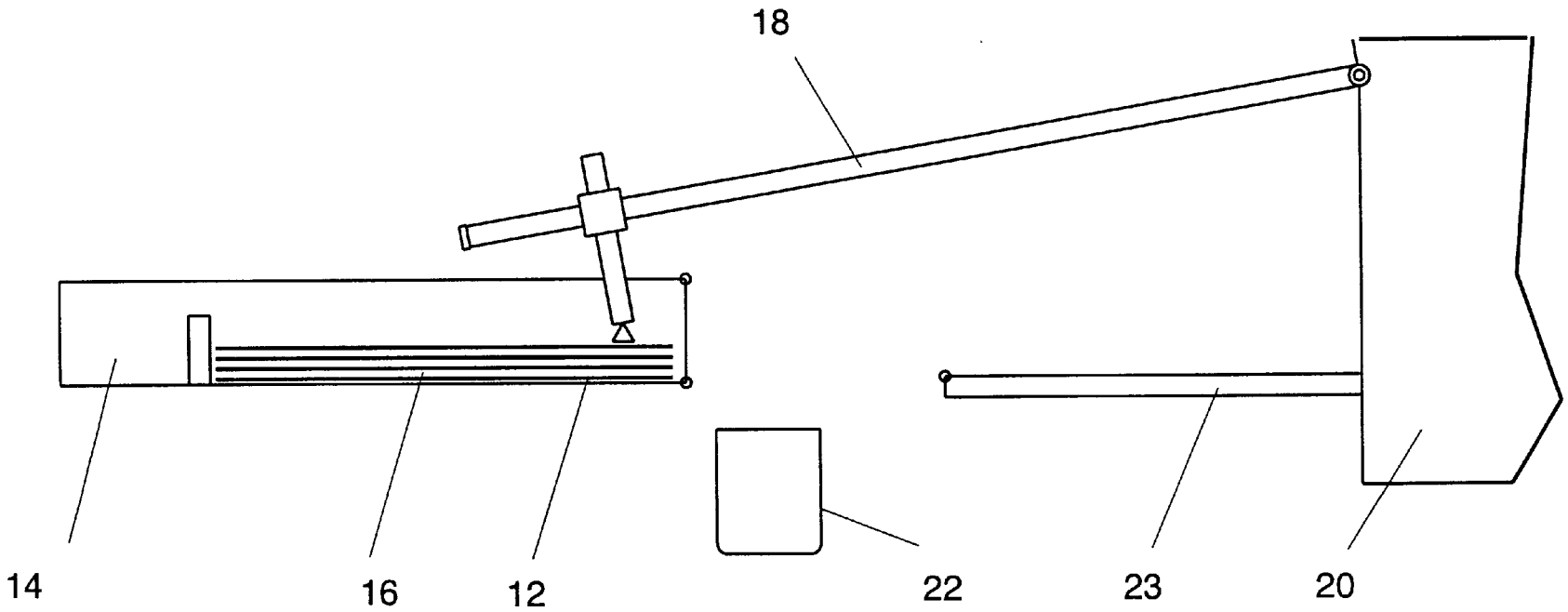
FIG.1 (PRIOR ART)
FIG. 1 schematically describes a prior art plate loading system from a single cassette.
Figure 3:
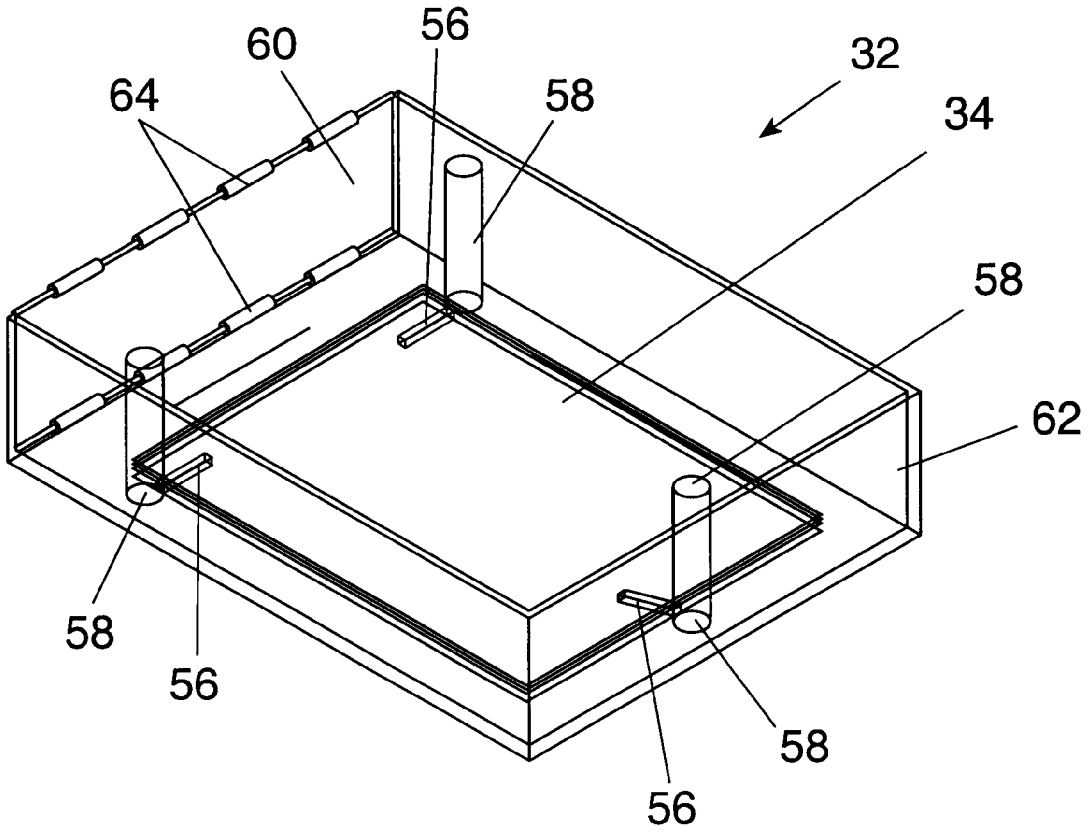
FIG. 3 schematically illustrates a tray for use with the staggered multi-tray plate loading system of FIG. 2.

Reference is now made to FIGS. 2A–2D and FIG. 3. FIGS. 2A–2D illustrate the multi-tray plate loading system, generally designated 30, constructed and operative in accordance with an embodiment of the present invention. FIG. 3 schematically illustrates a typical tray 32, for use with the multi-tray plate loading system of FIG. 2. Each tray 32 is shown containing a plurality of plates 34.

The multi-tray plate loading system 30 is especially suitable for the automatic loading of plates of various sizes into a plate setter or a printing plate imaging device, schematically illustrated, referenced 25.

The multi-tray plate loading system 30 includes a motorized arm mechanism, generally designated 36, pivotally connected to imaging device 25, for loading plates 34 from the trays 32 and feeding them to imaging device 25.

Referring now particularly to FIG. 2A, the multi-tray plate loading system 30 comprises a plurality of trays, referenced 32A, 32B and 32C holding stacks of plates referenced 34A, 34B and 34C respectively, of different sizes. Separation papers 38 are inserted to keep the plates apart from each other. The trays 32 are staggered one on top of the other. The offset distance between the trays is referenced W (FIG. 2A). In a typical application, W=70 mm.

Three trays are shown as an example only, but as, will be appreciated, any number of trays can be mounted one on top of the other in a staggered manner.

Arm mechanism 36 is pivotal about a pivot point 40. During the plate feeding/loading operation, arm mechanism 36 is substantially parallel to the stack of plates 34 in the trays 32. The arm mechanism 36 is tiltable so as to allow access to the trays 32.

Arm mechanism 36 comprises an arm 42, a motorized carriage 44, which can be activated to move along the arm 42, and a vertical rod 46 connected to motorized carriage 44.

The motorized carriage 44 can be stopped automatically at any desired position along arm 42.

Vertical rod 46 is movable vertically (perpendicular to arm 42) through motorized carriage 44, and can be stopped automatically at any desired position. Vertical rod 46 comprises a bar 48 suitably attached to rod 46 at its lower end, and an array of suction cups 50 attached to bar 48.

The bar 48 also carries separation grippers and sensors generally designated 70 which enable distinction between plate 34 and separation paper 38. The separation paper grippers may be any suitable known in the art devices, such as those described in U.S. Pat. No. 6,164.637, assigned to the common assignee of the present invention, described hereinabove.

The sensors may be any suitable known in the art devices and will not be further described. The distinguishing sensors are preferably of the electrical contact type, as known in the art.

Motorized carriage 44 is coupled to a control unit 52, which is preferably coupled to the control unit of imaging device 25. Motorized carriage 44 is any suitable device, such as the commercially available model 2EC "Powerslide" of Thomson Ind. Industries. of New York, USA.

Also illustrated is the loading plane 54 for receiving the plates being fed to imaging device 25.

Reference is now also made to FIG. 3, which illustrates a typical tray 32. The base of the tray 32 comprises three adjustable pins 58, located in slots 56, the adjustment of which defines the overall dimensions of the plate 34 being stored. Two pins are located proximal to an open end, referenced 60, and one of the pins is located approximately in the center and proximal to the other end, referenced 42. The pins 58 are inserted in the required slot 56, prior to loading the tray 32 with plates 34. The tray 32 is open at the top, thus allowing for easy loading of plates 34. Usually the plates 34 are stacked with their imaging sensitive layer facing downwards. At open end 60, two rows of rollers 64, for guiding the plates 34 being fed, are suitably fitted.

The dimensions of the tray 32 are determined by the maximum size of plates to be loaded and the maximum number of plates to be stacked.

Figure 4:
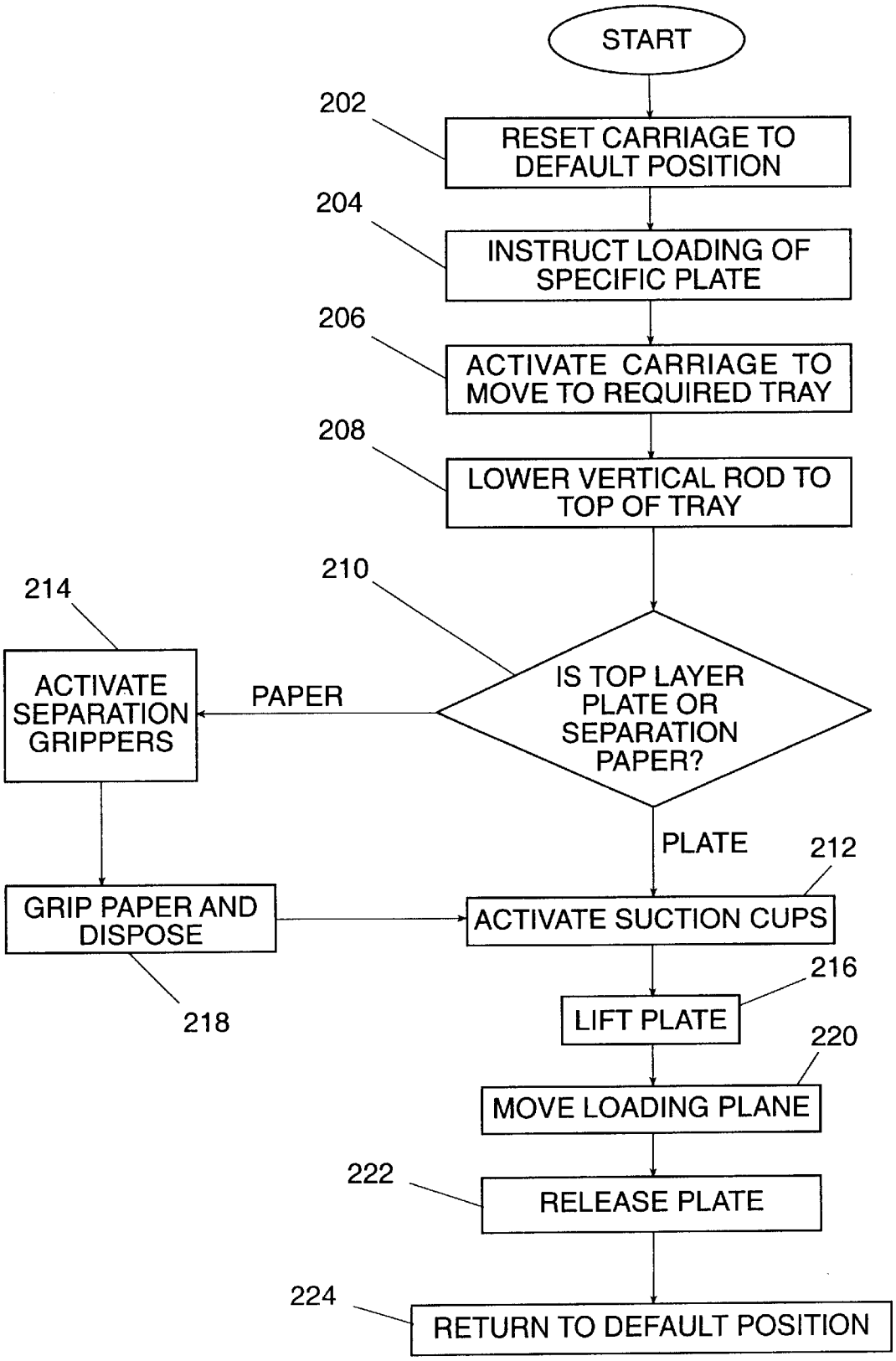
FIG. 4 is a flow chart illustration of a typical operation cycle of loading a plate to an imaging device out of a tray.

Reference is also made to FIG. 4 which is a flow chart illustration of a typical operation cycle of feeding a plate 34 to the imaging device 25.

As shown in the example of FIG. 2A, three trays 32 are stacked one on top of the other, and offset a distance W, as shown.

In the initial, non-activated mode, the motorized carriage 44 is located at its default position, that is at one end of arm 42, proximal to imaging device 25 (step 202). Vertical rod 46 is shown positioned at its highest point.

Upon receiving a command from control unit 52 (FIG. 2B), to load a plate of a specific size (step 204), the motorized carriage 44 is activated to move along the arm 42 towards the tray containing the required plate (say plate 34B in tray 32B)—(step 206).

Upon reaching the designated feeding position, motorized carriage 44 stops and vertical rod 46 descends until the suction cups (together with separation paper grippers and distinguishing sensors 70), are in contact with the uppermost plate in the tray (step 208). The following step is conditioned by the existence of separation paper between the plates, which might not exist for certain plates.

The distinguishing sensors indicate to the computerized control unit 52, whether the top layer is a separation paper 38 or a plate 34 (query box 210). Accordingly, depending on the upper layer, the computerized control unit 52 either activates the suction cups 50 (step 212) or the separation grippers (step 214).

On sensing contact with a plate 34, arm 42 is tilted so that the suction cups 50 are perpendicular to the plate 34. The suction cups 50 are then operated to grasp the plate 34 (step 212).

On the other hand, if the distinguishing sensors sense contact with separation paper 38 control unit 52 will activate the separation paper grippers (step 214) to grip the separation paper 38 and then dispose of it into the paper bin 22 (step 218).

After disposing of the separation paper 38 (step 218), the plate loading sequence commences. As shown in FIG. 2C, vertical rod 46 is activated to move upwards a predetermined amount, thus causing the suction cups 50 to lift the end of the plate 34 from the tray 32 (step 216).

As shown in FIG. 2D, the motorized carriage 44 is then activated to move (step 220) towards the loading plane 54 of the imaging device 25, dragging the plate 34 out of tray 32. The rollers 64 facilitate the smooth movement of the plates 34 over the edge of the tray 32.

On reaching the loading plane 54, rod 46 moves downwards and releases the plate 34 (step 222). The arm mechanism 36 is then returned to its initial position (step 224). The plate 34 is then fed into the imaging device 25 by methods known in the art, for example, U.S. Pat. No. 5,488,906 assigned to the common assignee of the present invention.

It will be appreciated by persons skilled in the art that the present invention is not limited to what has been particularly shown and described hereinabove. Rather the scope of the present invention is defined only by the claims which follow:

What is claimed is:

1. Automatic plate feeding system for loading plates into a printing plate imaging device, said system comprising:

a plurality of trays staggered one on top of the other; and an arm mechanism to load plates from said plurality of trays and to feed said loaded plates to said imaging device, wherein said arm mechanism comprises at least one sensor capable of distinguishing between said plates and separation papers interposed there between.

2. A system according to claim 1, wherein said arm mechanism comprises:

an arm pivotally connected to said imaging device;

a motorized carriage which is activatable to move along said arm; and a vertical rod connected to said motorized carriage, said vertical rod being movable in a direction generally perpendicular to said arm.

3. A system according to claim 2, wherein said vertical rod has at least one suction cup attached thereto for picking up said plates.

4. A system according to claim 3, wherein said vertical rod comprises grippers for gripping and releasing said separation papers.

5. A system according to claim 1, wherein said at least one sensor is an electrical contact sensor.

6. A system according to any of claims 1–3 or 4–5, wherein said mechanized arm is coupled to a control unit, said control unit being coupled to said imaging device, and said control unit activates the movement of said mechanized arm.

* * * * *

UNITED STATES PATENT AND TRADEMARK OFFICE

CERTIFICATE OF CORRECTION

PATENT NO. : 6,422,801 B1
DATED : July 23, 2002
INVENTOR(S) : Solomon, Yehuda Barnes It is certified that error appears in the above-identified patent and that said Letters Patent is hereby corrected as shown below:

Drawings,
Please replace figures 2-C and 2-D with the attached corresponding figures, wherein the indicating line to element 48 has been corrected.

Column 2,
Line 4, please replace “feeling” with -- feeding --

Signed and Sealed this

Sixth Day of July, 2004

JON W. DUDAS
*Acting Director of the United States Patent and Trademark Office*

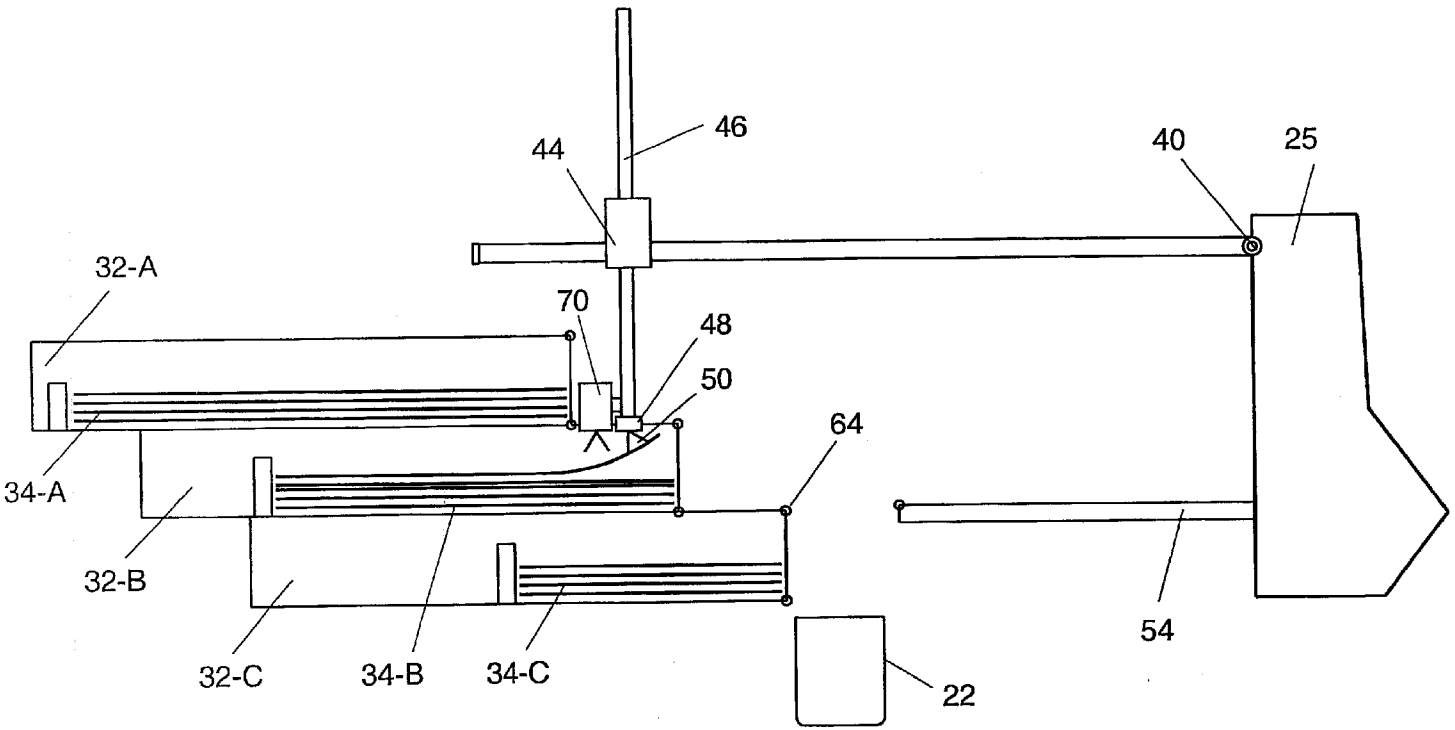
FIG.2-C

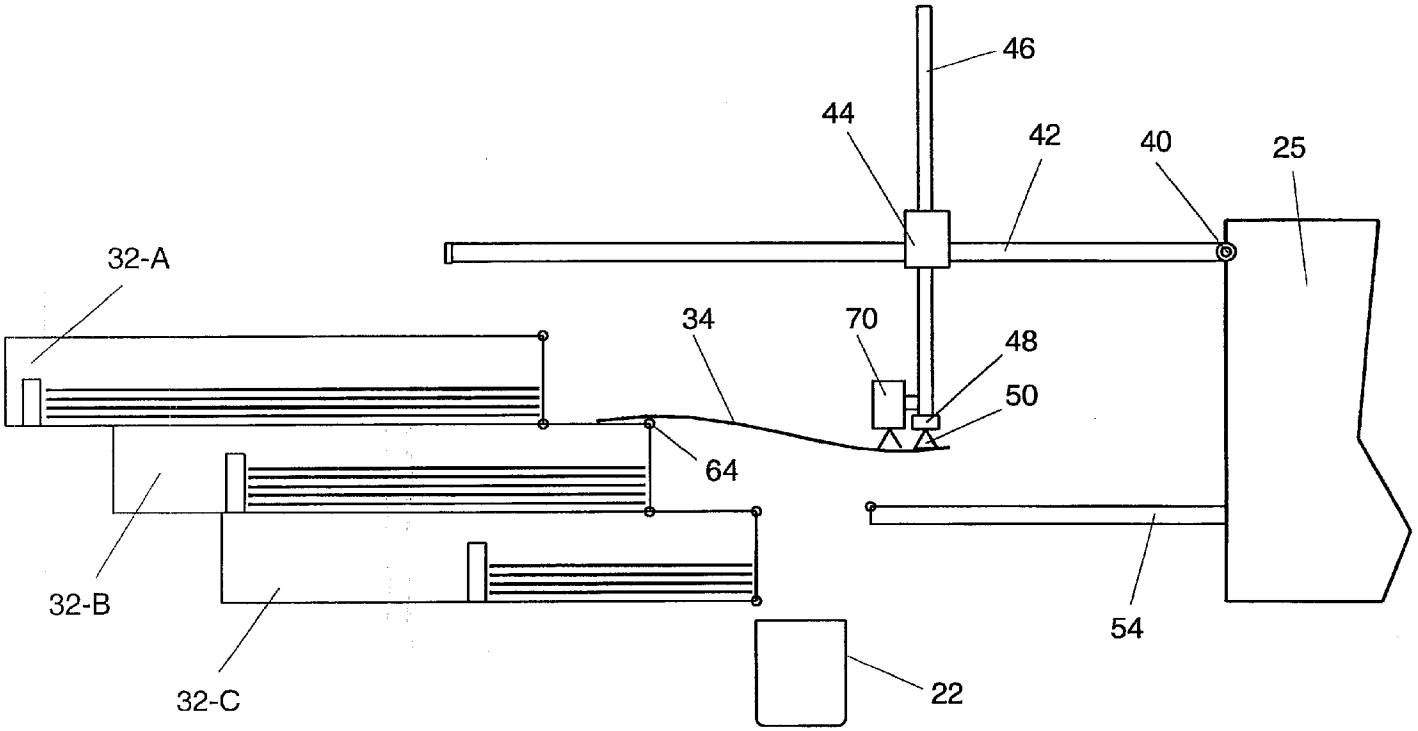
FIG.2-D